US005082150A

United States Patent [19]

Steiner et al.

[11] Patent Number: 5,082,150

[45] Date of Patent: Jan. 21, 1992

[54] LIQUID DISPENSING SYSTEM INCLUDING A DISCHARGE ASSEMBLY PROVIDING A POSITIVE AIR FLOW CONDITION

[75] Inventors: Robert L. Steiner; Charles R. Holzner, Sr., both of Chicago; Allen J. Voth, Oak Park, all of Ill.

[73] Assignee: Steiner Company, Inc., Chicago, Ill.

[21] Appl. No.: 517,244

[22] Filed: May 1, 1990

[51] Int. Cl.[5] ..... B67D 5/58

[52] U.S. Cl. ..... 222/189; 222/214; 222/490

[58] Field of Search ..... 222/189, 207, 214, 185, 222/481, 494, 568, 569, 490

[56] References Cited

U.S. PATENT DOCUMENTS

| | | | |
|---|---|---|---|
| D. 272,493 | 2/1984 | Steiner et al. | D6/542 |
| D. 282,347 | 1/1986 | Steiner | D9/403 |
| 2,772,817 | 12/1956 | Jauch | 222/207 |
| 3,149,758 | 9/1964 | Bush et al. | 222/189 |
| 3,734,098 | 5/1973 | Schneller et al. | 222/569 X |
| 4,130,224 | 12/1978 | Norman et al. | 222/185 |
| 4,301,799 | 11/1981 | Pope, Jr. et al. | 222/189 X |
| 4,314,658 | 2/1982 | Laauwe | 222/213 |
| 4,345,627 | 8/1982 | Cassia | 141/18 |
| 4,391,309 | 7/1983 | Steiner | 141/18 |
| 4,394,938 | 7/1983 | Frassanito | 222/207 |
| 4,429,812 | 2/1984 | Steiner et al. | 222/181 |
| 4,515,294 | 5/1985 | Udall | 222/105 |
| 4,533,068 | 8/1985 | Meierhoefer | 222/189 |
| 4,560,093 | 12/1985 | Cassia | 222/181 |
| 4,576,313 | 3/1986 | Smith et al. | 222/81 |
| 4,634,022 | 1/1987 | O'Halloran et al. | 222/214 X |
| 4,646,945 | 3/1987 | Steiner et al. | 222/207 |
| 4,673,109 | 6/1987 | Cassia | 222/153 |
| 4,776,495 | 10/1988 | Vignot | 222/207 |
| 4,886,192 | 12/1989 | Cassia | 222/181 |
| 4,917,271 | 4/1990 | Kanner et al. | 222/481 X |
| 4,930,667 | 6/1990 | Holzner, Sr. | 222/189 |
| 4,931,224 | 6/1990 | Holzner, Sr. | 261/30 |

FOREIGN PATENT DOCUMENTS

| | | |
|---|---|---|
| 1206034 | 2/1960 | France . |
| 2365997 | 4/1978 | France . |

*Primary Examiner*—Kevin P. Shaver
*Assistant Examiner*—Gregory L. Huson
*Attorney, Agent, or Firm*—Emrich & Dithmar

[57] ABSTRACT

A liquid dispenser having a replaceable unvented liquid container with only an outlet opening, a discharge assembly in liquid communication with the liquid container outlet opening, and including a compressible nipple for accommodating a charge of liquid, a check valve for regulating the flow of liquid into the nipple and a semipermeable filter mounted in and substantially filling the inlet to the check valve, the filter element being permeable to air to introduce air into the liquid container through its outlet opening, the filter element being impermeable to liquid to prevent back flow of liquid through the air passageway, and having an opening therethrough which is aligned with the inlet of the check valve, defining a liquid passageway through the filter element to the check valve.

16 Claims, 9 Drawing Sheets

Fig 1
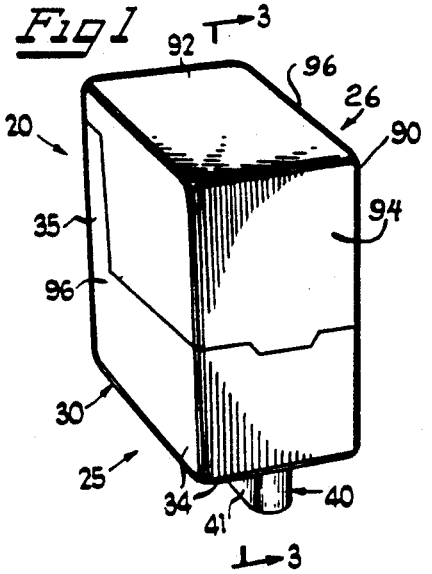
Fig 2
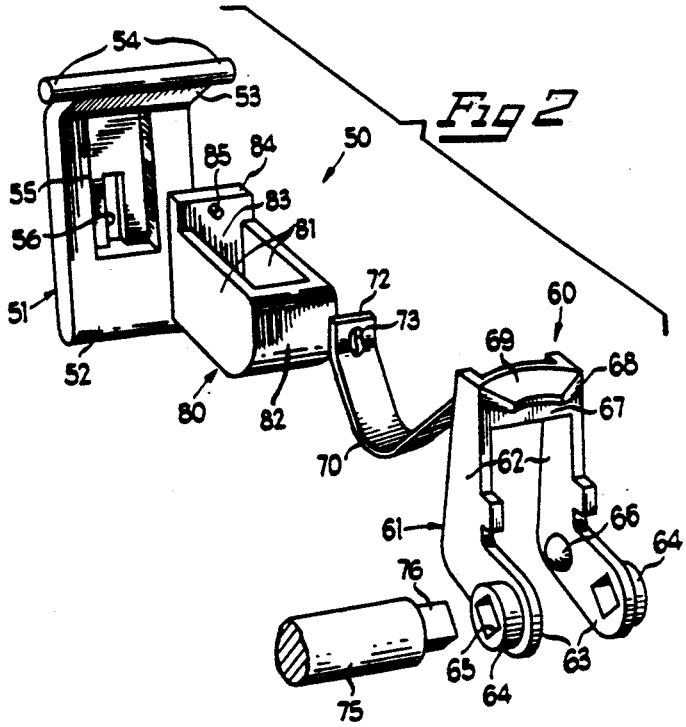
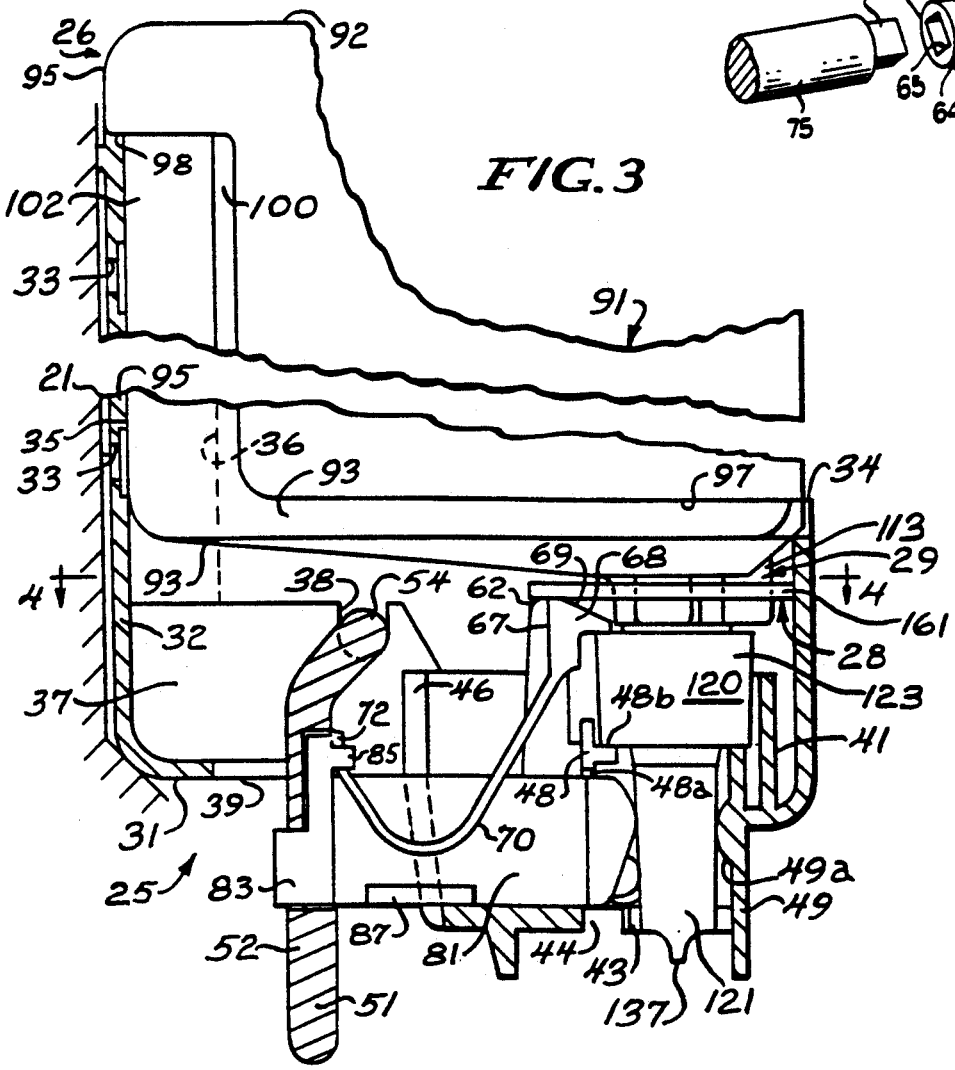
FIG. 3

FIG. 4
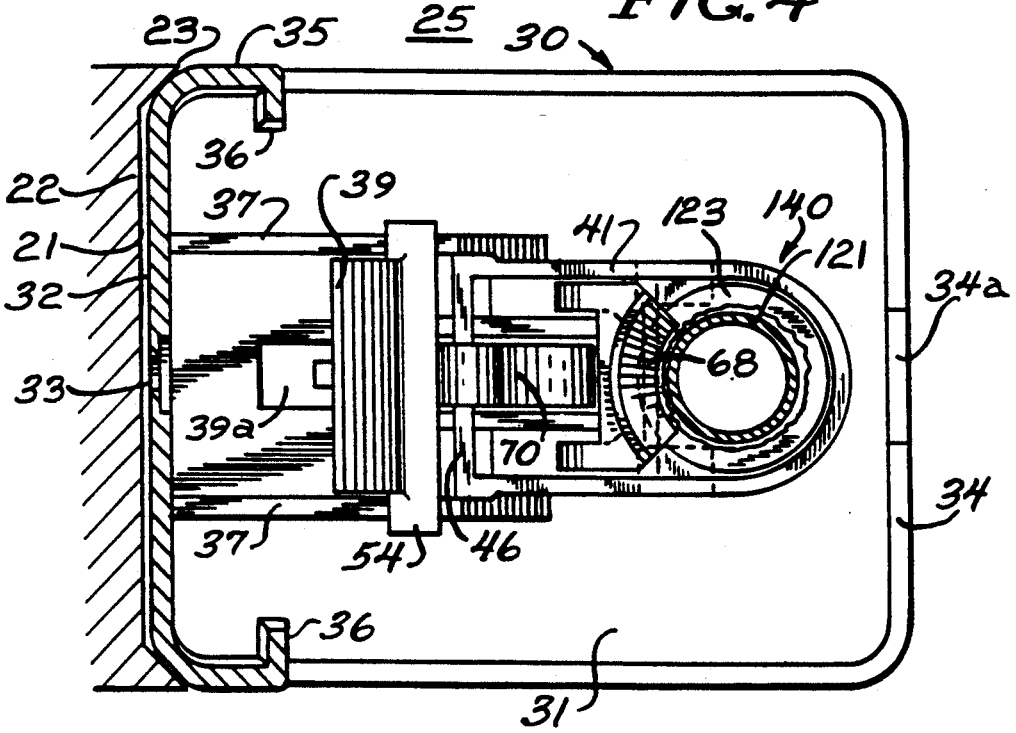
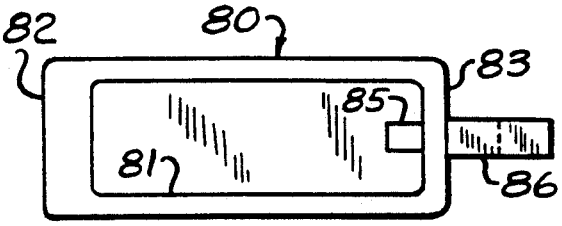
FIG. 5
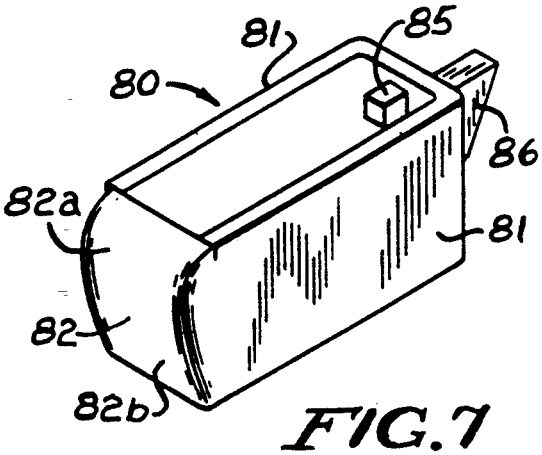
FIG. 7
FIG. 6
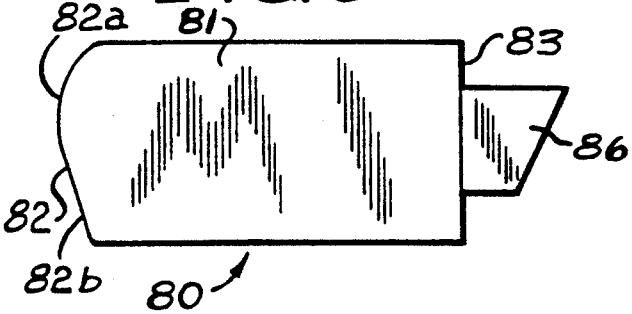

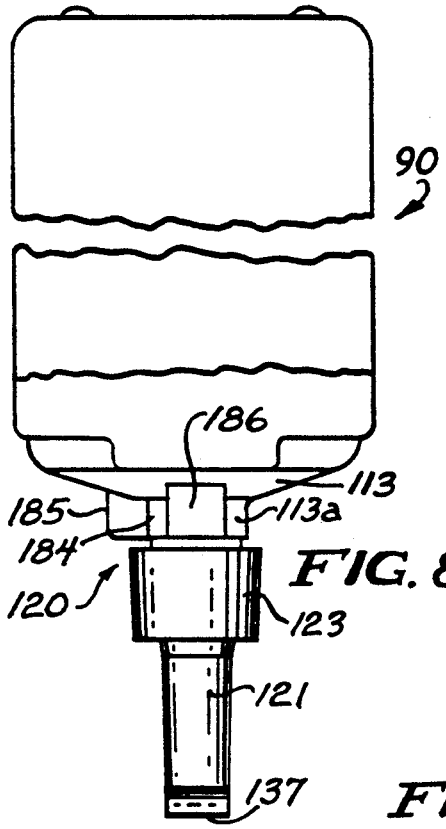
FIG. 8
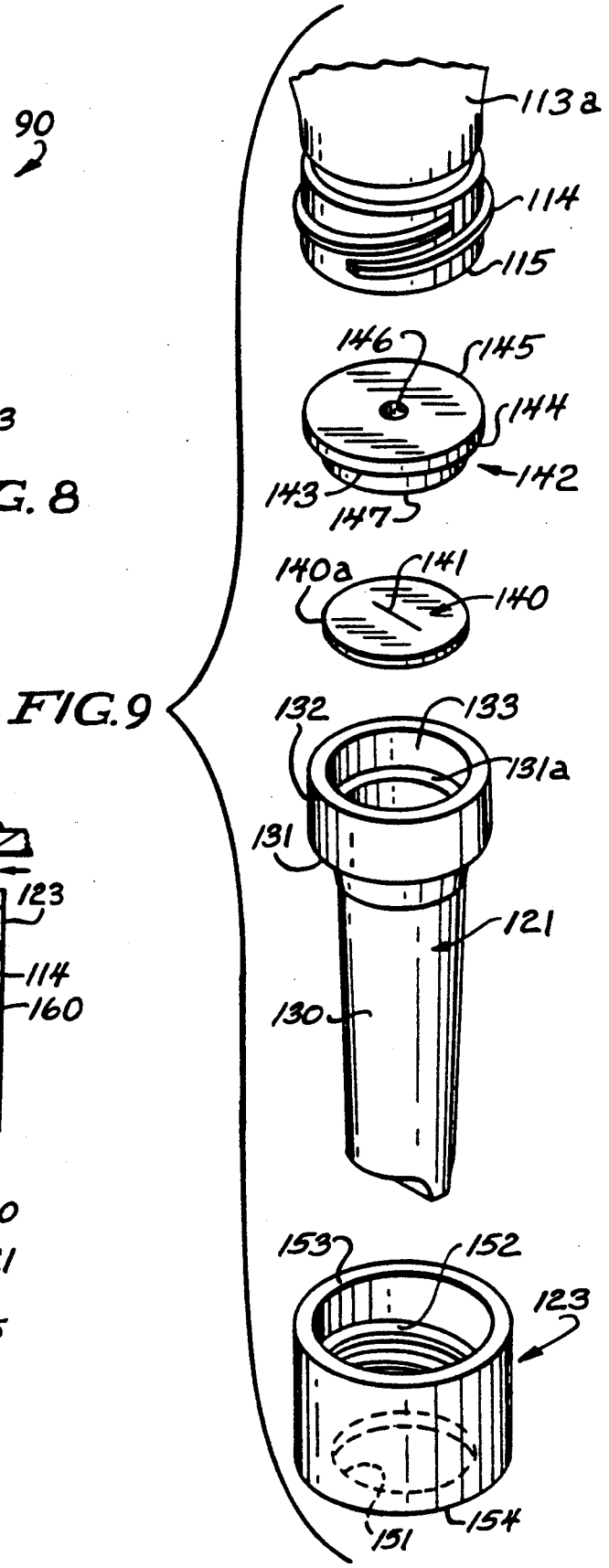
FIG. 9
FIG. 10
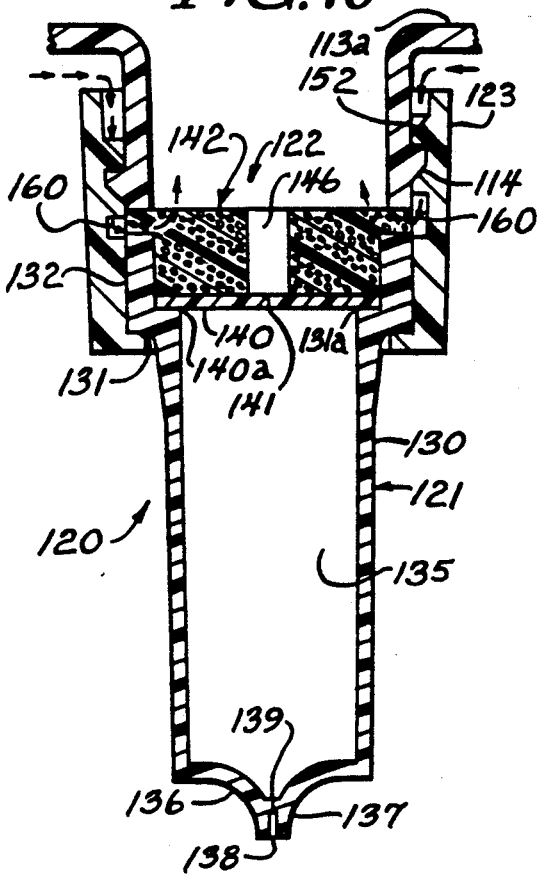

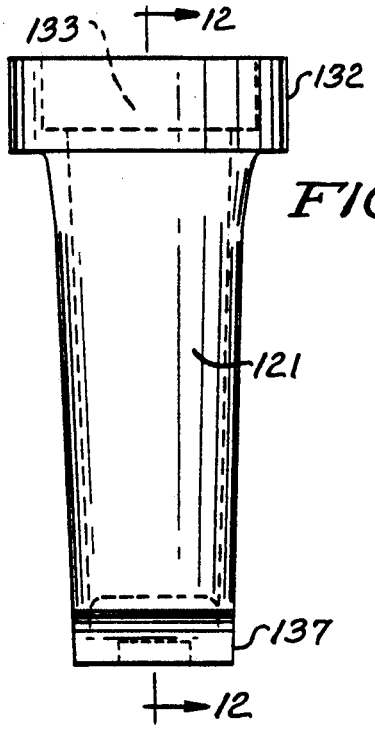
FIG. 11
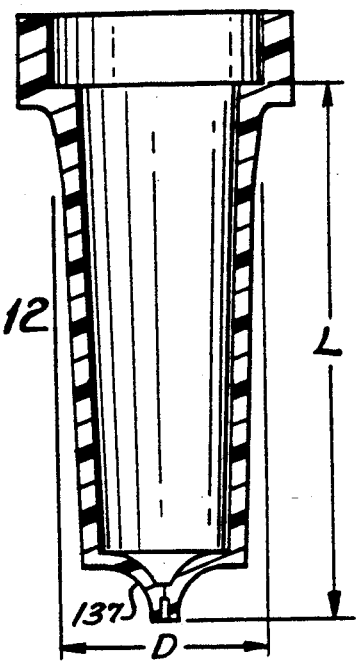
FIG. 12
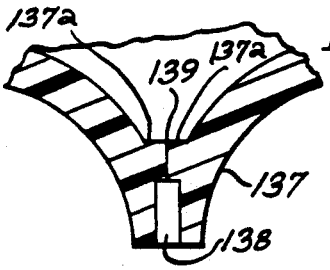
FIG. 13
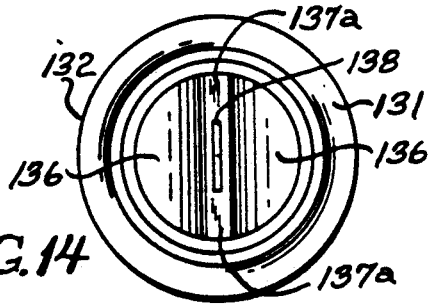
FIG. 14
FIG. 15
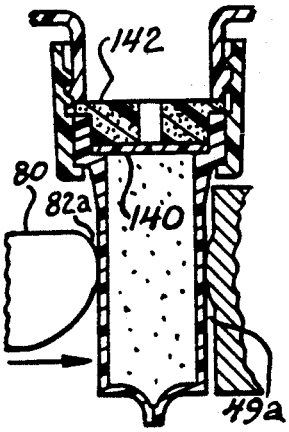
FIG. 16
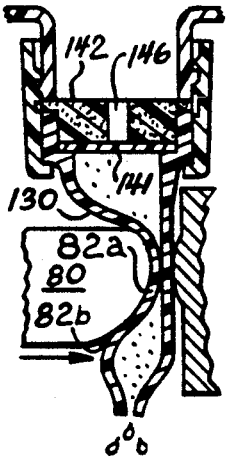
FIG. 17
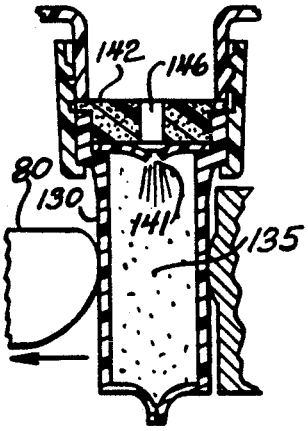

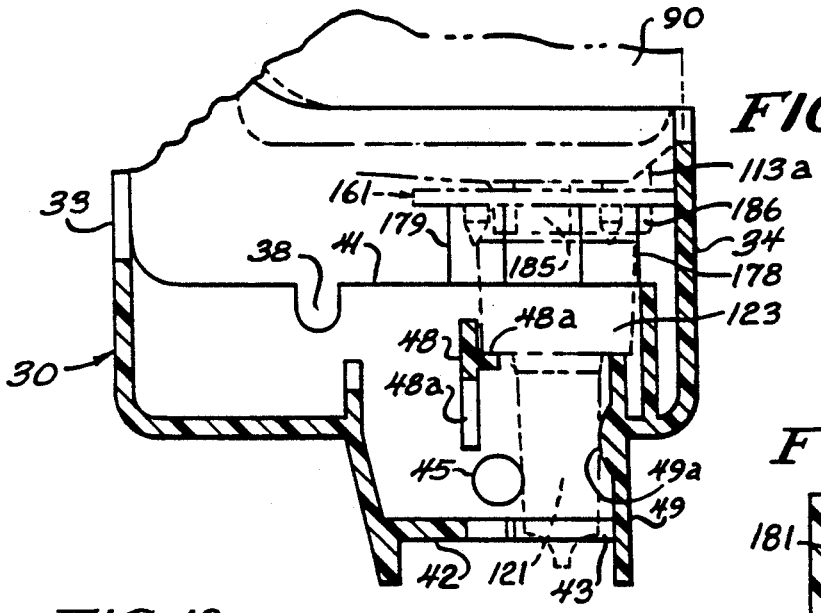
FIG. 18
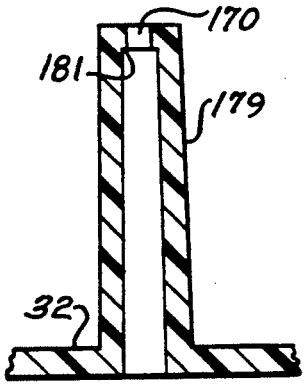
FIG. 20
FIG. 19
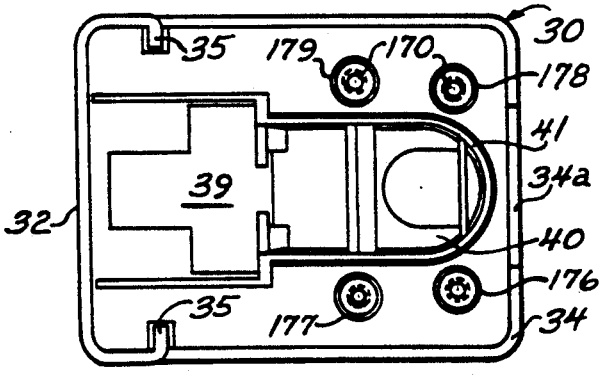
FIG. 21
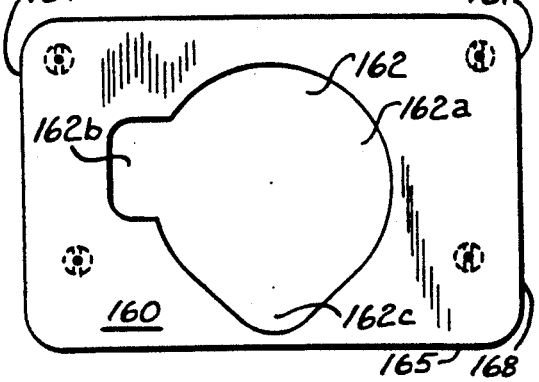
FIG. 22
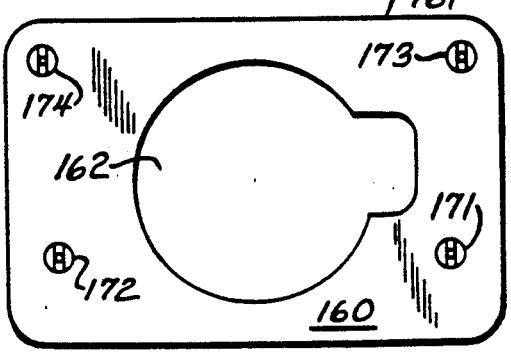
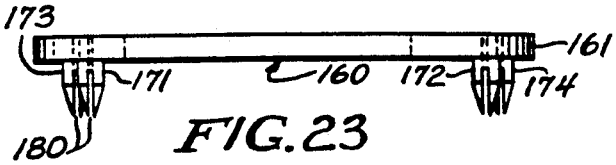
FIG. 23
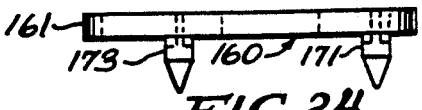
FIG. 24

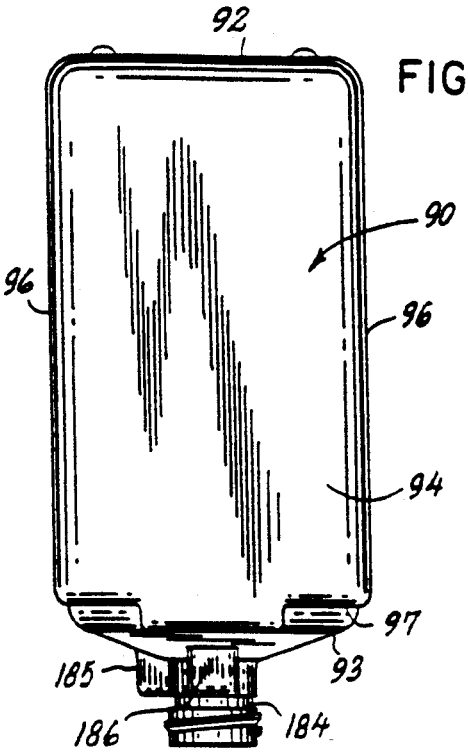
FIG. 25
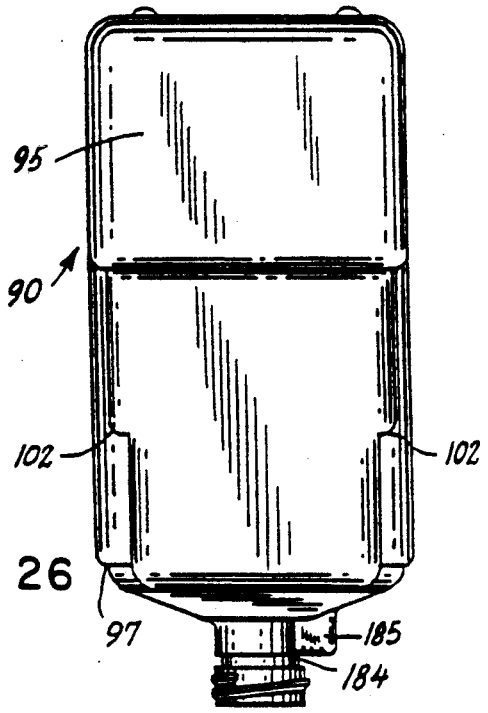
FIG. 26
FIG. 27
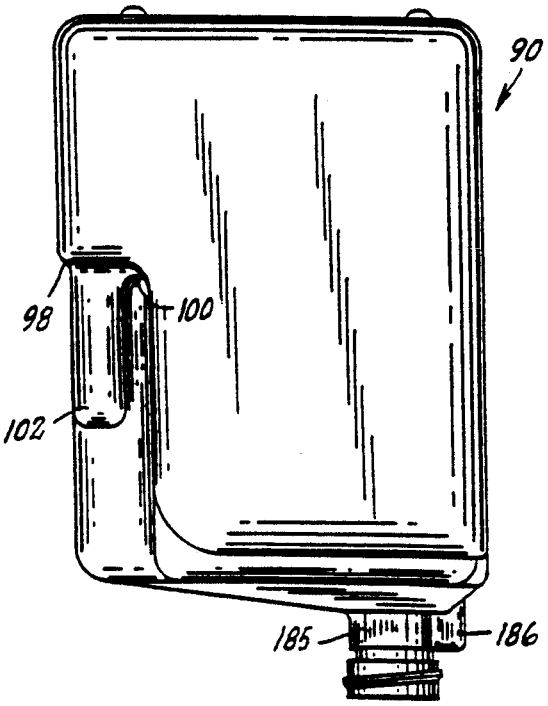
FIG. 28
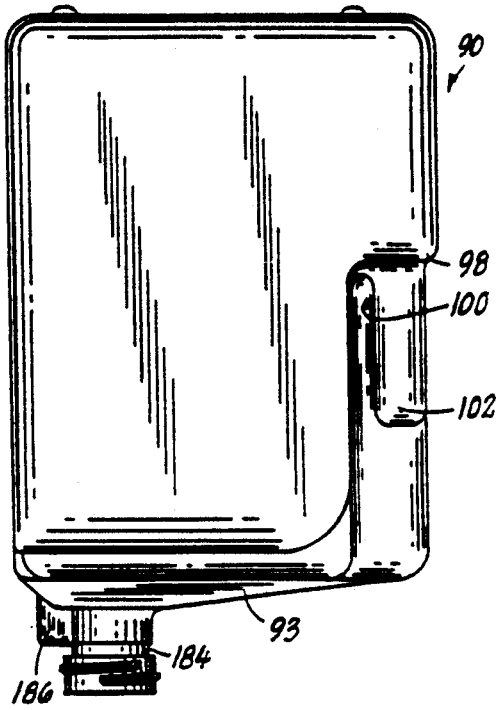

LIQUID DISPENSING SYSTEM INCLUDING A DISCHARGE ASSEMBLY PROVIDING A POSITIVE AIR FLOW CONDITION

BACKGROUND OF THE INVENTION

The present invention relates to apparatus for dispensing liquid, normally in discrete small quantities or charges. The invention has particular application to the dispensing of liquid from replaceable cartridges which may contain grit for scouring purposes.

One type of soap dispenser is disclosed in U.S. Pat. No. 4,108,363 and includes a flexible pump bowl which receives soap from a container through a diaphragm-type check valve. When the bowl is compressed it closes the check valve and forces the soap in the bowl out through a passageway to a discharge outlet. This structure is relatively complex and is not well suited to modern distribution networks which require field maintenance by unskilled laborers, nor is it suited to the dispensing of soap containing grit, since the grit tends to clog the passageways in the device thereby increasing maintenance problems.

A similar type of dispenser using a compressible pump bowl or nipple is disclosed in U.S. Pat. No. 1,326,880, the dispenser ejecting soap directly from a slit in the pump nipple. This dispenser utilizes a custom-made check valve stopper in the soap container outlet, and depends on distortion of the slit in the nipple for dispensing of soap therefrom. Thus, the nipple is compressed in the direction of the slit. This has the disadvantage that the slit can be opened permitting soap to drip therefrom before pressure in the nipple has been raised sufficiently to close the check valve.

Another type of soap dispenser is which includes mechanisms for dispensing discrete quantities of liquid soap. A problem which has been encountered in most of the prior art soap dispensing devices is that repeated discharges of the dispensing mechanism of the soap result in less than full quantities of soap being discharged after the initial operation. Basically this is because there is insufficient venting of the soap container or cartridge so that refill into the discharge nozzle or nipple is not sufficient for providing a full dosage when such soap dispensers are subjected to repeated rapid uses, as is common in public washrooms and the like.

Various soap dispensing systems have been proposed which solve the problem of providing full dosage for each dispensing operation by establishing an air passage between the inside of the soap container and the outside so as to continually provide full atmospheric pressure within the soap container irrespective of the number of discharge sequences.

For example, in U.S. Pat. No. 4,646,945, issued to Robert L. Steiner et al, there is disclosed a vented discharge assembly for a liquid soap dispenser including a valved vent opening separate from the outlet opening for the liquid soap for providing a vent path through the discharge assembly while effectively preventing discharge of liquid soap through the vent path. However, if the pump was depressed with excessive force, it was possible to pump the soap product past the valve and out the air intake opening, and the buildup of dried soap in the intake area could result in blockage of the air vent path.

Another vented discharge assembly for a liquid soap dispenser, disclosed in U.S. Pat. No. 4,930,667 (Ser. No. 299,934) issued to Charles R. Holzner, includes a semipermeable filter mounted between the discharge assembly and the soap container to introduce air into the soap container immediately upon withdrawal of soap from the container to permit rapid operation of the discharge assembly. The filter comprises a disc-shaped semi-permeable membrane installed in the air passageway which is offset radially from the liquid soap outlet opening. However, the air passageway has a relatively small cross section making it susceptible to becoming blocked as the result of soap drying on the filter membrane. Thus, it would be desirable to have a liquid dispensing system including a vented cartridge in which the air passageway is not susceptible to blockage.

Another problem that is inherent in this field is the use of unauthorized replacement cartridges in the dispensers. That is, although the dispenser is designed to accept a specific cartridge, third parties often attempt to enter the replaceable cartridge market and bootleg inferior soap products into the dispenser.

To avoid unauthorized cartridges being used in dispensers, anti-bootleg devices have been included in the dispenser mechanism to prevent the use of unauthorized cartridges therein. Examples of soap dispensers including anti-bootleg devices are disclosed, for instance, in Steiner et al U.S. Pat. Nos. 4,391,309 and 4,429,812. However, these prior art soap dispensers employ a dispensing pump mechanism which is integral with the housing which defines a reservoir from which soap is drawn in use. The cartridge is adapted for mounting on the housing and supplies soap to the reservoir by gravity. The anti-bootleg mechanism comprises a plurality of keys located in the inlet opening of the reservoir which prevent proper seating of unauthorized cartridges. In the event that a bootlegger attempts to use a standard cylindrical necked cartridge, the cartridge will not seat properly and soap will run out of the dispenser. However, such arrangement would not be usable in the liquid dispenser of the present invention wherein the pump mechanism is part of the container.

SUMMARY OF THE INVENTION

It is a general object of the invention to provide an improved liquid dispenser including a discharge assembly which avoids the disadvantages of prior devices while affording additional structural and operating advantages.

Another object of the invention is the provision of a discharge assembly for a liquid dispenser which is suitable for dispensing full discrete charges in rapid succession.

A further object of the invention is the provision of a discharge assembly for a liquid dispenser which is of simple and economical construction, and is characterized by ease of assembly.

Still another object of the invention is the provision of a discharge assembly for a liquid dispenser including a venting arrangement which ensures full dosage for rapid repeat operation of the discharge assembly.

Yet another object of the invention is to provide a discharge assembly for a liquid dispenser including a venting arrangement which provides a more positive air flow condition than ;;as provided by prior art venting arrangements.

It is another object of the invention to provide a liquid dispenser of the type including a replaceable liquid cartridge which includes an anti-bootleg structure for preventing unauthorized cartridges from being used.

In accordance with the invention, there is provided a liquid dispenser comprising, an unvented liquid container having only an outlet opening, a discharge assembly in liquid communication with the liquid container outlet opening, the discharge assembly including discharge means defining a discharge chamber for accommodating a charge of liquid and an inlet chamber for introducing liquid to the discharge chamber, and check valve means in the inlet chamber for regulating the flow of liquid from the container to the discharge chamber, the check valve means including a valve member and a semipermeable filter element mounted in and substantially filling the inlet chamber between the valve member and the liquid container outlet opening, the filter element being of a material which is permeable to air for establishing an air passage to introduce air into the liquid container upon withdrawal of liquid from the container, and the filter element material being of a material which is impermeable to liquid, the element having an opening therethrough defining a passageway for liquid from the container outlet opening to the valve member for introduction into the discharge chamber.

In accordance with another aspect of the invention there is provided a discharge assembly for a liquid dispenser including a liquid container having an outlet opening, the discharge assembly comprising an elongated flexible resilient nipple having a normal expanded condition defining a discharge chamber for accommodating a charge of liquid and having a longitudinal axis, the nipple having first and second ends with an inlet chamber at the first end thereof and being provided at the second end thereof with a normally closed discharge slit, retaining means mounting the nipple on the container with the inlet chamber disposed in registry with the container outlet opening, check valve means disposed in the inlet chamber and including a valve member and a semipermeable filter element substantially filling the inlet chamber, the filter element being permeable to air and impermeable to liquid, the retaining means establishing an air passage through at least a portion of the filter element to the interior of the liquid container, the filter element having an opening therethrough defining a passageway for liquid from the container outlet to the valve member for introduction into the discharge chamber, the nipple being laterally compressible in a direction substantially perpendicular to the axis, movement of the nipple to the compressed condition thereof raising the pressure in the discharge chamber for closing the check valve and ejecting liquid from the discharge slit, movement of the nipple back to the expanded condition thereof lowering the pressure in the discharge chamber for closing the discharge slit and opening the check valve to draw a new charge of liquid into the discharge chamber, passage of air through the filter element rapidly reestablishing air pressure in the liquid container permitting rapid refill of the discharge chamber with liquid and rapid activation of the discharge means.

In accordance with another aspect of the invention there is provided a liquid dispensing system comprising a dispenser and a replaceable liquid cartridge removably mountable on the dispenser, the dispenser including a housing and an actuating mechanism mounted in the housing, the liquid cartridge including a liquid container having an outlet and a discharge assembly mounted on the container closing the outlet and anti-bootleg means mounted in the housing in overlying relationship with the actuating mechanism, the anti-bootleg means having an opening therethrough of a predetermined configuration, the container having a neck portion complementary in shape to the opening through the anti-bootleg means, permitting the neck portion to pass through the anti-bootleg means to mount the cartridge on the housing with the discharge assembly disposed in operative relationship with the actuating mechanism for dispensing liquid from the container, and the anti-bootleg means preventing cartridges without a neck portion of the predetermined configuration from being mounted on the housing with their discharge assembly disposed in operative relationship with the actuating mechanism.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a perspective view of a liquid dispensing system, constructed in accordance with and embodying the features of the present invention;

FIG. 2 is an enlarged, exploded, perspective view of the actuator mechanism of the liquid dispensing system of FIG. 1;

FIG. 3 is a further enlarged, fragmentary view in vertical section taken along the line 3—3 in FIG. 1, and illustrating the actuator mechanism in its normal reset configuration;

FIG. 4 is a view in horizontal section taken along the line 4—4 in FIG. 3;

FIG. 5 is a top plan view of the plunger of the actuator mechanism;

FIG. 6 is a side elevational view of the plunger of the actuator mechanism;

FIG. 7 is a perspective view of the plunger of the actuator mechanism;

FIG. 8 is a view of a liquid cartridge including a liquid container and a discharge assembly which are constructed in accordance with and embodying the features of the present invention;

FIG. 9 is an exploded view of the discharge assembly illustrated in FIG. 8;

FIG. 10 is an enlarged, fragmentary view in vertical section of the discharge assembly;

FIG. 11 is a front elevational view of the nipple of the discharge assembly;

FIG. 12 is a sectional view taken along the line 12—12 of FIG. 11;

FIG. 13 is an enlarged fragmentary view of the nipple, illustrating details of its discharge outlet;

FIG. 14 is a bottom view of the nipple of the discharge assembly;

FIGS. 15–17 are simplified fragmentary views of the discharge assembly in vertical section illustrating successive stages of liquid discharge and recharge;

FIG. 18 is a view in section of the housing of the liquid dispensing system illustrated in FIG. 1 showing the anti-bootleg device with the liquid cartridge illustrated in phantom, mounted on the housing;

FIG. 19 is as top plan view of the housing with the anti-bootleg device removed;

FIG. 20 is an enlarged, fragmentary view, in section, taken along the line 20—20 in FIG. 19;

FIG. 21 is a top plan view of the anti-bootleg device of the housing;

FIG. 22 is a bottom plan view of the anti-bootleg device illustrated in FIG. 21;

FIG. 23 is a front elevational view of the anti-bootleg device illustrated in FIG. 21;

FIG. 24 is a side elevational view of the anti-bootleg device illustrated in FIG. 21;

FIG. 25 is a front elevational view of a liquid container of the liquid dispensing system illustrated in FIG. 1;

FIG. 26 is a rear elevational view of the liquid container;

FIG. 27 is a left side elevational view of the liquid container;

FIG. 28 is a right side elevational view of the liquid container;

DESCRIPTION OF PREFERRED EMBODIMENT

Figure 29:
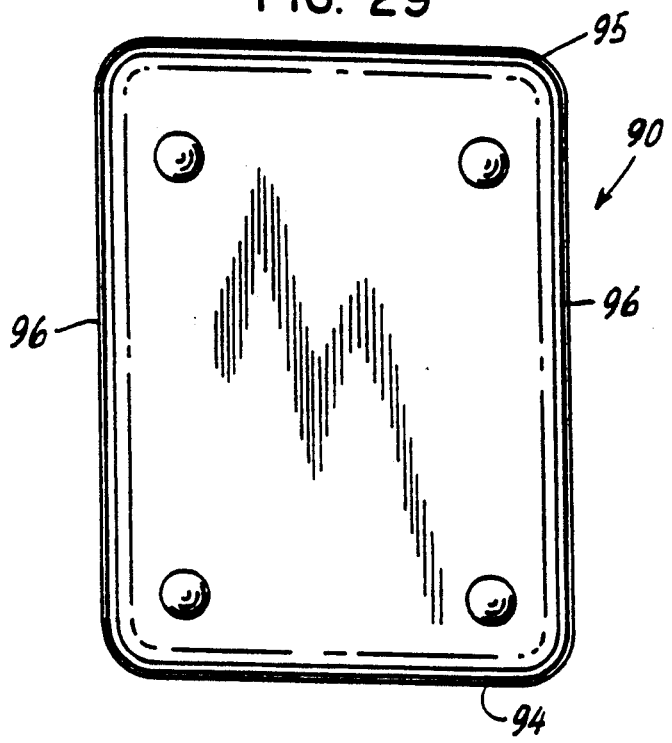
FIG. 29 is a top plan view of the liquid container.
Figure 30:
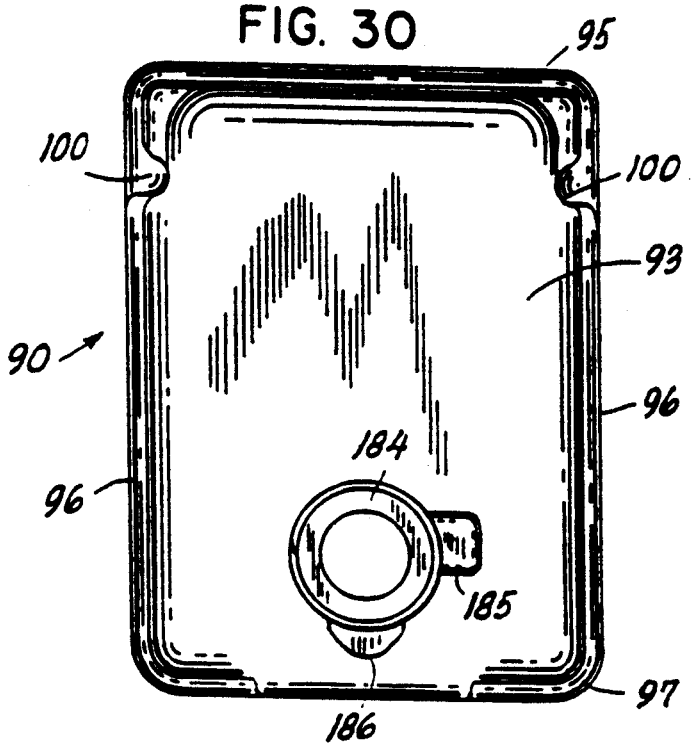
FIG. 30 is a bottom plan view of the liquid container.

Referring to FIGS. 1-4, there is illustrated a liquid dispensing system, generally designated by the numeral 20, constructed in accordance with and embodying the features of the present invention. The liquid dispensing system 20 comprises a dispenser 25 adapted to be mounted on an associated support surface 21, such as on a wall 22 and, more particularly, in a recess 23 therein (see FIGS. 3 and 4), and a disposable liquid cartridge 26 which contains a supply of liquid and is removably mountable on the dispenser 25 for cooperation therewith to control the dispensing of liquid therefrom. The liquid may be liquid soap, alcohol, jel, suntan oil, or any material that flows. In accordance with one aspect of the invention, the liquid cartridge includes a discharge assembly which allows mounting of the cartridge on the dispenser without specific orientation therebetween. Moreover, the discharge assembly includes a filter which prevents contaminated air from entering the cartridge, which filter allows a more positive air flow condition than is provided by known liquid dispensing systems of the type which are vented through their outlet opening. In accordance with a further aspect of the invention, the liquid dispenser includes an anti-bootleg structure for preventing unauthorized cartridges from being used with the dispenser, the anti-bootleg structure including an anti-bootleg device 28 secured to the dispenser and a cooperating surface configuration 29 for the cartridge neck, as will be described. Preferably the cartridge 26 is inexpensively manufactured so as to be disposable.

More specifically, the dispenser 25 includes a housing 30, which is preferably of unitary, one-piece construction and may be formed of molded plastic. The housing 30 is similar to the housing disclosed in U.S. Pat. No. 4,673,109, which is assigned to Steiner Corporation. The housing 30 includes a flat rectangular base wall 31 and an upstanding rectangular mounting wall 32 integral with the base wall 31 at the rear edge thereof and disposed substantially perpendicular thereto. The mounting wall 32 may have fastener holes 33 therethrough for receiving associated fasteners (not shown), securely to mount the housing 30 on the associated support surface 21. The housing 30 and cartridge 26 define mating edge surfaces providing a retaining system like that for the dispenser and cartridge illustrated in the referenced U.S. Pat. No. 4,673,109. To this end, integral with the base wall 31 and extending upwardly therefrom along the front and side edges thereof is a continuous peripheral flange 34, having a stepped down portion 34*a* on the front edge. Side flanges 35 are respectively integral with the side edges of the mounting wall 32 and project forwardly therefrom to join the peripheral flange 34. Respectively integral with the side flanges 35 at the forward or distal edges thereof, and projecting laterally inwardly therefrom substantially parallel to the mounting wall 32, are two retaining rails 36, each extending the entire length of the mounting wall 32 to the base wall 31.

Briefly, referring to FIGS. 1 and 3, and also to FIGS. 25-28 of the drawings, the cartridge 26 includes a liquid container 90 and a liquid discharge assembly 120 which is described in detail hereinbelow. The liquid container 90 is a generally box-like container, which may be formed of a suitable plastic material. Preferably, the container 90 is generally in the form of a rectangular parallelepiped having a top wall 92, a bottom wall 93, a front wall 94, a rear wall 95 and a pair of opposed side walls 96. The front wall 94 and the side walls 96 are set back or recessed along their lower edges adjacent to their junction with the bottom wall 93 to define a support shoulder 97. The top wall 92 projects rearwardly a slight distance beyond the rear wall 95 to form an overhang which defines a stop flange 98. Formed in the container 91 at the junctions of the rear wall 95, respectively, with the side walls 96, are two elongated longitudinal grooves 100 which extend from the level of the stop flange 98 downwardly to the bottom wall 93. The lower portions of the grooves 100 are cut away, as at 101, so as to define lugs 102 adjacent to the upper ends of the grooves 100. The cartridge outer surfaces are all dimensioned so that when the cartridge 26 is in its use position on the dispenser the outer surfaces of the front wall and the side walls are, respectively, substantially coplanar with corresponding portions of the housing so as to present an attractive, smooth outward appearance. Also, the retaining system formed by rails 36 and grooves 100 prevent forward tilting of the cartridge relative to the dispenser.

Referring again to FIGS. 1-4, integral with the base wall 31 and with the mounting wall 32 and substantially perpendicular to each are a pair of laterally spaced-apart, upstanding support plates 37, respectively provided with laterally aligned bearing notches 38 in the upper edges thereof (see FIG. 3) Formed in the base wall 31 is an elongated, generally rectangular opening 39 (FIGS. 3 and 4) which extends laterally between the support plates 37, the opening 39 having a rearwardly extending rectangular arm 39*a* and having an arcuate forward end.

Integral with the housing 30 is a receptacle 40 having a peripheral wall 41 which lines the forward portion of the opening 39, the peripheral wall 41 having an arcuate front end and parallel side portions, which side portions are respectively parallel to the support plates 37 and are integral with the inner surfaces thereof at the front ends thereof. The peripheral wall 41 projects above and below the base wall 31 and is closed at its lower end by a bottom wall 42 which is disposed substantially parallel to the base wall 31. The bottom wall 42 has a circular opening 43 therein adjacent to the forward end thereof, and a generally T-shaped slot 44 therethrough (FIG. 3) just rearwardly of the circular opening 43. Respectively formed in the side portions of the peripheral wall 41 below the base wall 31 are two laterally aligned circular pivot openings 45 (FIG. 18).

Integral with the rear ends of the side portions of the peripheral wall 41 and projecting laterally inwardly therefrom are two rear flanges 46, each having a notch or recess 47 at the lower end thereof. A stop web 48 laterally spans the side portions of the peripheral wall 41, extending a slight distance above and below the base wall 31, the web 48 having a rectangular notch **48*a* in the lower edge thereof and a forwardly directed ledge portion 48*b* near its upper end. A rectangular stop web 49 is formed integrally with and extends upwardly from the base wall 31. Web 49 is disposed substantially parallel to the stop web 48 and laterally spans the peripheral wall 41 near its arcuate front end. The upper edge of the stop web and the upper surface of the ledge portion 48*b* lie substantially in a common horizontal plane. Web 49 has a rearwardly directed boss 49*a* which is semi-cylindrical in shape and extends substantially the width of the web 49**.

The dispenser 25 also includes an actuator assembly 50 which is removably mounted in the housing 30. The actuator assembly 50 includes a handle 51 comprising a rectangular plate 52 provided at its upper end with an inclined portion 53, which is in turn provided at its distal end with laterally outwardly extending cylindrical pivot lugs 54. The pivot lugs 54 are respectively received in the bearing notches 38 for pivotally supporting the handle 51 which extends through opening 39 in the housing bottom, for movement between actuating and retracted positions. The plate 52 has a width slightly less than the width of the opening 39, so that the base wall 31 at the rear end of the opening 39 and the rear flanges 46 of the receptacle 40 provide rear and front stops to limit the pivotal movement of the handle 51. Formed in the front surface of the plate 52 is a rectangular recess 55, near the lower end of which is formed a rectangular slot 56 which extends through the thickness of the plate 52 midway between the side edges thereof and in position so as to be disposed below the base wall 31 when the handle 51 is disposed in its mounted condition in the housing 30.

The actuator assembly 50 also includes a bias unit 60 which comprises a latch member 61 and a bias leaf 70. The latch member 61 is generally in the form of a clevis having a pair of parallel, spaced-apart arms 62, respectively provided with angled feet 63, at the lower ends thereof. The feet 63 are respectively provided with laterally outwardly extending circularly cylindrical pivot lugs 64, each having a substantially square key socket 65 formed in the outer end thereof, which may extend laterally completely therethrough.

Each of the feet 63 is also provided on its inner surface with a bearing boss 66. The arms 62 are interconnected at their upper ends by a bight portion 67 provided with a forwardly extending latch flange 68 having a part frustoconical cam surface 69 thereon which locks the cartridge in place on the dispenser. The latch member 61 is dimensioned to fit within the receptacle 40 with the arms 62 respectively disposed along the inner surfaces of the side portions of the peripheral wall 41. For mounting, the arms 62 are resiliently deflected together to permit the pivot lugs 64 to clear the inner surfaces of the peripheral wall 41, and then the latch member 61 is lowered into the receptacle 40 until the pivot lugs 64 respectively snap out into the pivot openings 45 (FIG. 18), pivotally to mount the latch member 61. The length of the arms 62 is such that when the latch member 61 is in this mounted condition, the latch flange 68 is disposed a predetermined distance above the upper end of the receptacle 40.

The bias leaf 70 comprises a thin, flat, rectangular band which is formed of a suitable flexible and resilient material, such as a suitable plastic. One end of the bias leaf 70 is fixedly secured to the rear surface of the bight portion 67 of the latch member 61 by suitable means (not shown). The bias leaf 70 is fabricated with predetermined curvature therein, and is provided with a curved tip 72 at its distal end which has a rectangular slot 73 therethrough. There is also provided a key 75 having a lug 76 thereon which is disposed for mating engagement in one of the key sockets 65 to effect manual rotation of the latch member 61 about the axis of the pivot lugs 64 for releasing the cartridge when spent, allowing replacement with a full cartridge.

The actuator assembly 50 also includes a plunger 80, which is generally in the shape of a rectangular, box-like, open-top frame. More particularly, referring to FIGS. 2–7, the plunger 80 includes a pair of parallel rectangular side walls 81 interconnected, respectively, at the forward and rearward ends thereof by a front bearing wall 82 and a rear wall 83.

The front bearing wall 82 curves forwardly and downwardly from its upper edge to a point of maximum forward extension defining cam surface **82*a* which is approximately one third the distance from its upper edge to its lower edge, the front bearing wall portion 82*b* extending linearly downwardly and rearwardly from its point of maximum forward extension to its bottom edge. Thus, the front bearing wall 82 defines a generally arcuate cam surface 82*a* which is offset upwardly of the horizontal center line of the plunger 80 and following surface 82*b***.

The arcuate cam surface **82*a* is aligned with and in opposing relation to the boss portion 49*a* on web 49. The rear wall 83 is provided with a forwardly extending pin 85 which is received in slot 73 of bias leaf 70. Integral with the outer or rear surface of the rear wall 83 is a rearwardly extending rectangular positioning lug 86 which is received in slot 56 in the handle 51. The side walls 81 are interconnected at the lower edges thereof, intermediate the front and rear ends thereof by a rectangular bottom web 87. The plunger 80 is dimensioned so that it can fit between the notches 47 of the receptacle rear flanges 46, through the notch 48*a* in the stop web 48 and between the bearing bosses 66 of latch member 61 for reciprocating siding movement forwardly and rearwardly along the bottom wall 42 of the receptacle 40 between pumping and release positions in response to operation and release of the handle 51**.

The parts of the actuator assembly 50, viz., the handle 51, the bias unit 60 and the plunger 80, can be quickly and easily assembled with the housing 30 without the use of tools and, when thus assembled, will cooperate with each other and with the housing 30 to retain the actuator assembly 50 in the housing 30 and prevent accidental removal thereof. The manner in which the actuator assembly 50 is assembled in the housing is described in detail in the referenced U.S. Pat. No. 4,673,109.

Referring to FIGS. 1, 3 and 8–10, the liquid cartridge 26 includes a liquid container 90 and a discharge assembly 120. Integral with the liquid container 90 at the distal end thereof is a cylindrical nozzle or neck 113 which projects downwardly from the bottom wall and which includes a thin wall portion 113*a* which defines an outlet opening for the container 90. The neck portion 113 of the liquid container 90 is externally threaded as at 114 and has an end surface 115, as seen in FIG. 8. The discharge assembly 120 includes an elongated, generally circular nipple 121 and a check valve assembly 122. The discharge assembly 120 is mounted on the threaded neck portion of the liquid container and maintained thereon by a retaining cap 123.

Referring to FIGS. 9–14, the nipple 121 is formed of a suitable flexible resilient material, such as rubber. The nipple 121 has a main body portion defined by a cylindrical side wall 130 which is provided at its proximal end with a radially outwardly extending flange 131 and an annular upstanding wall 132 defining an inlet chamber 133 for the discharge assembly. The hollow main body portion defines a discharge chamber 135 for the discharge assembly. The side wall 130 is provided at its distal end with a pair of radially inwardly sloping concave walls 136 which cooperate to form a flat, narrow duckbill-shaped tip 137 at the distal end of the nipple, closing the discharge chamber 135. Formed in the tip 137 and extending longitudinally thereof, substantially diametrically of the nipple 130, is an elongated slot 138 which in length is approximately one-half the diameter of the nipple. The upper edge of the slot 138 terminates in an elongated discharge slit 139, which is normally held closed by the resilient biased nipple 130. Also, the slit 139 extends along only a portion, approximately one-third, of the length of the duck-bill tip 137. Non-slitted top portions 137*a* on each side of the slit 139 assist in maintaining the slit 139 closed in the absence of release pressure in the nipple discharge chamber 135. The slit 139 is recessed relative to the distal tip of the nipple by an amount corresponding to the depth of the slot 138. The ratio of the length "L" of the main body portion and tip of the nipple to the average diameter "D" is about 3 to 1. This extended length of the nipple 121 and the improved tip construction together with the profile of the plunger front bearing wall 82 enable the cartridge to be installed on the dispenser without orientation of the nipple relative to the plunger. That is, it is not essential that the nipple be oriented relative to the plunger such that it is compressed in a direction perpendicular to the discharge slit 139.

As shown in FIGS. 9–10, the check valve assembly 122 includes a valve diaphragm disc 140 and a filter member 142. The valve diaphragm 140 is a thin, flat circular membrane or diaphragm dimensioned to fit within the inlet chamber or well 133 defined by the upstanding annular wall 132 of the nipple 121 with its lower peripheral edge 140*a* supported by a ledge or shoulder portion 131*a* defined by the inner upper surface of flange 131. The diaphragm is made of a suitable flexible material which is impermeable to liquid. The diaphragm has a straight-line check valve slit 141 formed therein centrally thereof and extending substantially diametrically.

The filter member 142 has a cylindrical main body portion 143 with an annular flange 144 extending outward radially at its upper surface 145. The filter member 142 has an axial bore 146 formed therethrough centrally thereof from its upper surface 145 to its lower surface 147. The outer diameter of the main body portion 143 at its distal end surface 147 corresponds to the outer diameter of the valve diaphragm, which diameters are slightly less than the inner diameter of the well 133 defined by the annular wall 132 of the nipple. The outer diameter of the top surface 145 including the flange 144 is approximately the same as the outer diameter of annular wall portion 132 of nipple 121. The filter member 142 may be made from any suitable material which permits air to pass therethrough but which does not permit liquid to flow therethrough, such as a hydrophobic cell structured thermoplastic. Material particularly suitable for this purpose is commercially available. Representative thermoplastics are nylon, polyesters, polypropylene and teflon, polyurethane, ABS and the like, produced for instance by Filtertek, Inc. of Hebron, Ill. The filter element is a molded porous plastic material having a pore size in the range of about 0.2 microns to about 40 microns.

In use, the valve diaphragm 140 is positioned in the well 133 with its peripheral edge 140*a* supported on the ledge portion 131*a*. The filter member 142 is positioned in the well 133 with its lower surface 147 engaging the upper surface of the valve diaphragm over substantially its entire extent and with the under surface of its flange engaging the top edge surface of the annular wall 132. Thus, when the discharge assembly is assembled with a cartridge, the filter member 142 substantially fills the entire inlet chamber or well 133 of the nipple between the outlet of the container and the valve diaphragm 140. Moreover, because the filter presents a large surface area to the outlet of the liquid container 90 and is located in contact with the liquid, the filter material is continually wetted by the liquid and thus will not become clogged by dried or hardened liquid. The aperture 146 through the filter member 142 is aligned with the valve slit 141 in the valve diaphragm by virtue of its being located axially of the filter member, and defines a passageway for liquid to the valve disc.

The retaining cap 123 is in the form of a cylindrical collar which has a central aperture 151 of a size through which the main body portion of the nipple 121 may pass. The retaining cap has internal threads 152 between its upper edge surface 153 and its lower edge surface 154 which are dimensioned loosely to engage the external threads 114 on the liquid container neck 113 and with the liquid container lower edge 115 engaging the upper surface 145 of the filter member 142. The retaining cap 123 serves to removably mount the discharge assembly 120 on the neck of the container 112. Because the retaining ring 123 removably secures the discharge assembly to the container 90, it is possible to recover discharge assemblies from spent cartridges, if desired.

The discharge assembly controls the flow of liquid between the outlet opening of the container 90 and the inlet opening or inlet chamber 133 of the nipple 121. An air path is thereby established, as best seen by the arrows in FIG. 10, between outside the container 90 and the inside thereof, which air path flows between the neck 13 of the liquid container 90 and the upper edge 153 of the cylindrical collar 123 through and along the threads 114 and 152 and thereafter through the space 160 and through the filter member 142 into the liquid container 90.

In use, when the discharge assembly 30 has been assembled and mounted on the container as described above, the check valve assembly 122 is disposed for controlling the flow of liquid between the outlet opening of the container 90 and the inlet opening or inlet chamber 133 of the nipple 121.

Referring to FIGS. 1, 2 and 18, in mounting the cartridge 26 on the dispenser 25, it is placed over the dispenser 25 with the neck 113 disposed downwardly. The cartridge 26 is slid down along the mounting wall 32 of the housing 30, with the retaining rails 36 being respectively recessed in the longitudinal grooves 100. As the cartridge is lowered into its use position, the nipple 121 extends downwardly into the receptacle 40 between stop webs 48 and 49 and in coaxial alignment with the circular opening 43 in the bottom wall 42. The latch flange 68 of latch member 61 projects forwardly beyond stop web 48, engaging the top surface edge 153 of the cap 123 so as to obstruct the path of the neck 112, latching the cartridge in place. The lower edge 154 of the retaining cap 123 rests on ledge 48*a* and on the upper edge 49*b* of web 49, locating the main body portion 130 of the nipple 121 between the forward cam surface 82*a* of the plunger 80 and the rearwardly extending boss 49*a* on the front web 49.

Referring to FIGS. 3, 8 and 15-17, the operation of the discharge assembly 120 will be explained. With the continual feed of air into the liquid container 90, the atmospheric pressure plus the weight of the liquid in the container on the diaphragm disc 140 near the slit 141 therein will force the check valve slit 141 open, allowing liquid to flow through the check valve slit opening into the discharge chamber 135 in the nipple 121. This flow will continue until the discharge chamber 135 is filled, at which time the pressure on the opposite sides of the valve disc 140 will be equalized, thereby allowing the check valve slit 141 to close in an equilibrium condition, as illustrated in FIG. 15. The nipple 121 is so constructed that in this normal equilibrium condition, the natural resilient bias of the nipple 121 will hold the discharge slit 139 closed against the weight of the charge of liquid contained in the discharge chamber 135.

In order to dispense a charge of liquid, a user places his palm under the nipple 121 and pulls the handle 51 (FIG. 3) forwardly towards its actuating position with his fingers. This drives the plunger 80 forwardly of the housing to its pumping position against the force of bias member 70, and into engagement with the nipple 121, compressing it, as shown in FIG. 16, between the cam surface 82*a* and the boss 49*a* on forward wall 49, ejecting the charge of liquid therefrom through the discharge outlet 137 of the nipple 121. Initially, the tip of the cam surface 82*a* engages the nipple main body portion near its upper end, compressing the nipple near its upper end. With continued forward linear movement of the plunger 80, the upper end of the nipple will be pinched closed by the cam surface 82*a* while the liquid contained in the nipple is forced out as following surface 82*b* of the plunger compresses the nipple in a downward motion as it is being engaged by following surface 82*b*.

The compression of cylindrical wall 130 of the nipple 121 raises the pressure in the discharge chamber 135, so that it holds the check valve slit 141 of the valve diaphragm 140 closed and against the under side of filter member 142 to force the ejection of a charge of liquid from the discharge chamber 135. Because the center of the check valve disc 140 is held against the filter member 142 during the discharge operation, no change in the pressure in the liquid container occurs at this time. When the handle 51 is released, the plunger 80 will return to its normal rest position under the urging of the bias member 70, and the compressed wall 132 of the nipple 121 will return to its normal expanded condition, see FIG. 17, as a result of the natural resilience of the nipple 121. This reexpansion of the nipple 121 will lower the pressure therein to a pressure below that in the container 90, so as to allow the check valve slit 141 to open under the force of atmospheric pressure and the weight of the liquid in the container. Hence, a new charge of liquid is drawn from the container 90 (thereby creating lower pressure in container 90) through aperture 146 in the filter member 142 and the check valve opening 141 and the diaphragm disc 140 into the discharge chamber 135 of the nipple 121. The rate at which the liquid flows into the nipple 121, and particularly into the discharge chamber 135, is controlled to some extent by the pressure in the liquid container 90. The pressure is equalized to normal atmospheric pressure by means of the air path established between the inside of the liquid container 90 and the atmosphere (which path is shown by the arrows in FIG. 10) and flows through the filter member 142 and the inlet chamber 133. Particularly, the air flows downwardly past the upper edge 153 of the retaining cap 123 through and around the mating threads 114, !52 and into the annular space beneath the threads and hence through the filter member 142 to the liquid container outlet, and into the container 90. This mechanism permits air to flow into the liquid container 90 while retaining the liquid therein. This construction facilitates rapid discharge and charge of the discrete quantities of liquid from the nipple 121 and is an improvement over the previous constructions heretofore mentioned.

Thus, the liquid dispensing system provided in accordance with the present invention includes a discharge assembly and an actuating mechanism therefor which allows mounting of the cartridge on the dispenser without specific orientation of the nipple of the discharge assembly relative to the plunger of the actuating mechanism. Moreover, the discharge mechanism includes a filter element which is constructed and arranged to both define a portion of an air passageway for venting the liquid container through its outlet opening and for providing a passageway for liquid from the container to the discharge nipple, the filter element allowing a more positive air flow condition than is provided by known liquid dispensing systems of the type employing containers vented through their outlet opening.

Referring to FIGS. 3, 18, 19 and 21-30 in accordance with another aspect of the invention, the dispenser 25 includes an anti-bootleg structure 28 including anti-bootleg device 160 for preventing unauthorized cartridges from being used in the dispenser 25. The anti-bootleg device 160, best shown in FIGS. 21-24, comprises a flat plate-like member 161 generally rectangular in shape and having a central opening 162 therethrough of an irregular shape, complementary with irregular shaped neck portion 164 of the associated container 26 shown in FIGS. 25-30. The plate member 161 has a forward edge 165, a rearward edge 166, a left side edge 167 and a right side edge 168. The irregular shaped opening 162 includes a generally circular central aperture 162*a* with a generally rectangular-shaped extension 162*b* extending toward the left side edge 167 of the plate and an arcuate segment 162*c* extending toward the forward edge 165 of the plate member.

The plate member 161 is mounted on the housing 30 (FIG. 18) overlying the well 40 which receives the discharge assembly 120 of the cartridge 26, with the neck of the cartridge 26 extending through the irregular shaped aperture 162 of the plate member 161. It is apparent that only cartridges which have a neck portion configured to pass through the irregular opening 162 in the anti-bootleg device 160 can seat on the dispenser 25 in such a way as to permit the discharge assembly 120 of the cartridge 26 to be operated by actuator mechanism of the dispenser.

For the purpose of mounting the anti-bootleg device 160 on the housing, the device 160 has four projections or lugs 171–174 which depend from lower surface 175 of the plate 161, one located near each of the four corners of the plate. The housing 30 has four supports or posts 176–179 which are formed integrally with and extend upwardly from the base 42 of the housing 30. Two of the posts 176–177 are located on the left side of the well and the other two posts 178–179 are located on the right side of the well 40. All four posts extend to a height above the upper edge of the well 40 to locate the anti-bootleg device 160 in overlying relation with the well and slightly above the upper edge surface of the well. The lugs 171–174 are split at 180 and are dimensioned to be received in apertures 170 through the respective posts 176, 178, 177, and 179, which apertures are stepped outwardly in a direction from top to bottom, defining an inner shoulder 181. The lugs may be retained in the apertures 170 by a snap fit, ultrasonic welding or other means to permanently secure the plate 161 to the housing.

As illustrated in FIGS. 22 and 23, the spacing between lugs 171 and 172 near the forward edge 165 of the plate 161 is less than the spacing between lugs 173 and 174 near the rearward edge 166. Correspondingly, the spacing between the forwardly located posts 176 and 178 is less than the spacing between the rearwardly located posts 177 and 179 to ensure proper orientation of the plate 161 when it is installed on the housing.

Referring now to FIGS. 25–30, the liquid container 90 is particularly adapted to be received by the dispenser 25 including the anti-bootleg device 160. The neck 113 of the container 90 has a generally cylindrical portion 184 of a diameter corresponding to the diameter of the aperture 162*a* in the plate 161 and with a generally rectangular boss 185 and an arcuate boss 186 which are complementary to aperture extension portions 162*b* and 162*c*, respectively, of the aperture 162 in the anti-bootleg plate 161.

Various combinations of rectangular and arcuate aperture portions can be used to define many unique irregular shapes for anti-bootleg device 160 and cartridges for use exclusively therewith. Moreover, only the anti-bootleg device 160 need be different, permitting manufacture of a "generic" dispenser unit, adapted by application thereto of a given anti-bootleg device to receive a given cartridge. For example, referring now to FIGS. 31–34, there are illustrated four cartridges 191–194 each having a different irregular-shaped neck portion for use with a dispenser having, respectively, one of the four anti-bootleg devices 195–198 illustrated in FIGS. 35–38.

Figure 31:
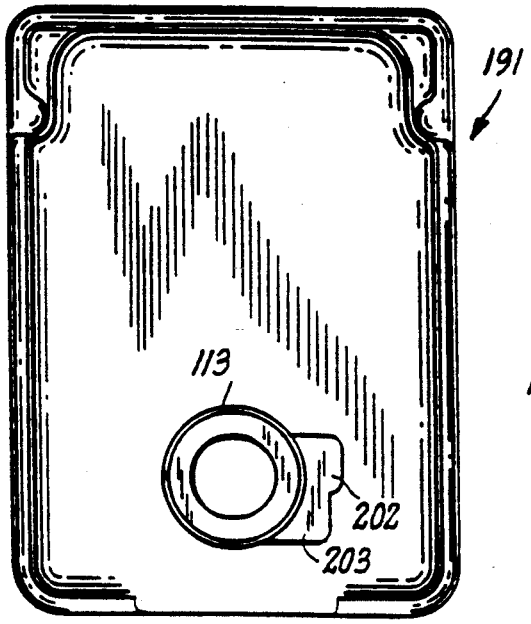
FIGS. 31-34 are bottom plan views of liquid containers having alternative configurations for preventing unauthorized use.
Figure 35:
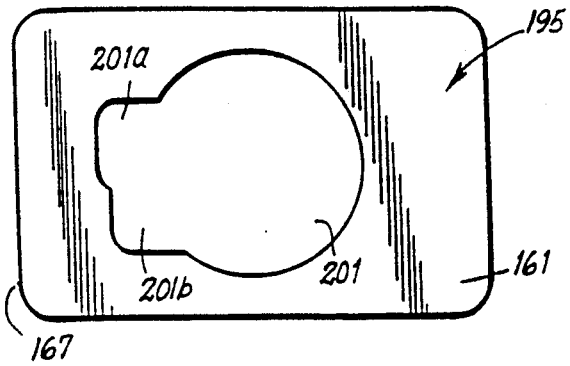
FIGS. 35-38 are top plan views of anti-bootleg devices for use with the liquid containers shown in FIGS. 31-34, respectively.

Referring to FIGS. 31 and 35, device 195 has an irregular-shaped opening 201 having two rectangular extension portions 201*a* and 201*b* which extend toward its left side edge 167 of the plate member 161. Portion 201*a*, which is the same shape and at the same location as portion 162*b* (FIG. 21), is longer than portion 201*b*. Correspondingly, the neck 113 of container 191 has complementary shaped rectangular bosses 202 and 203, which are disposed in the neck 113 and dimensioned to pass through the irregular opening 201 in the device 195.

Figure 32:
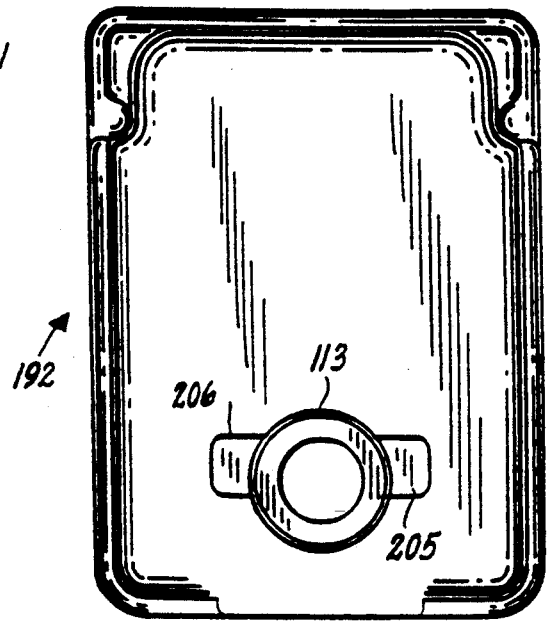
Figure 36:
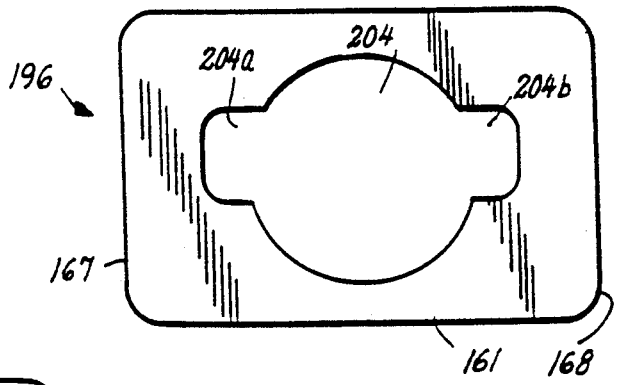

Referring to FIGS. 32 and 36, device 196 has an irregular opening 204 having two generally rectangular extension portions 204*a* and 204*b*, which are the same shape as portion 101*a* and extend, respectively, towards its left side edge 167 and its right side edge 168 rearward of the center line of the plate 161. The neck 113 of container 192 has complementary shaped bosses 205 and 206, which are so disposed on the neck 113 and dimensioned to pass through the irregular opening 204 in the device 196.

Figure 33:
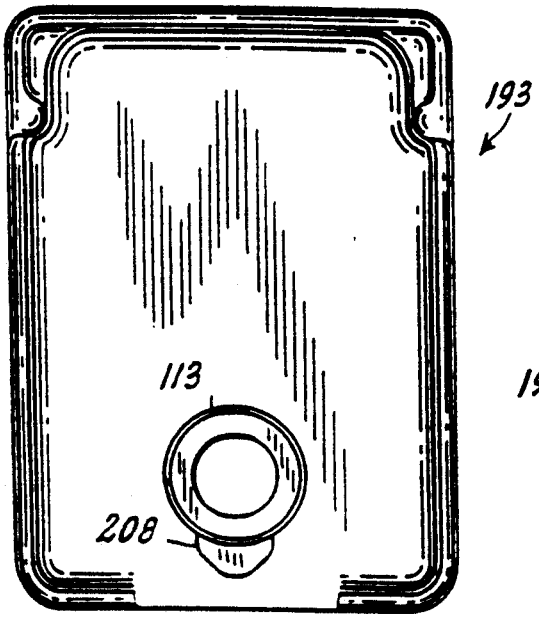
Figure 37:
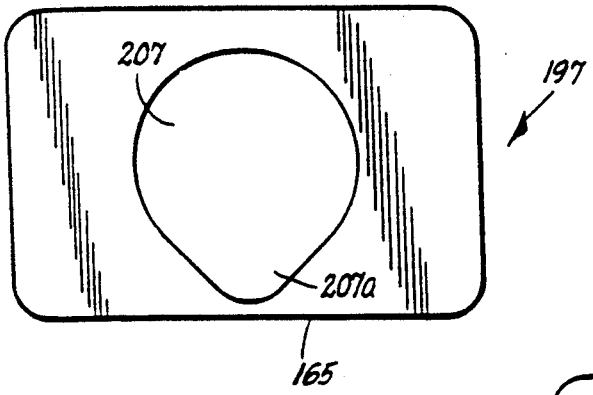

Referring to FIGS. 33 and 37, device 197 has an irregular shaped opening 207 having an arcuate extension portion 207*a* which is the same shape and at the same location as portion 162*c* of device 160 (FIG. 21) and which extends towards its forward edge 165. Associated container 193 has a complementary boss 208 on its neck 113 which is disposed to pass through the irregular opening in the device 197.

Figure 34:
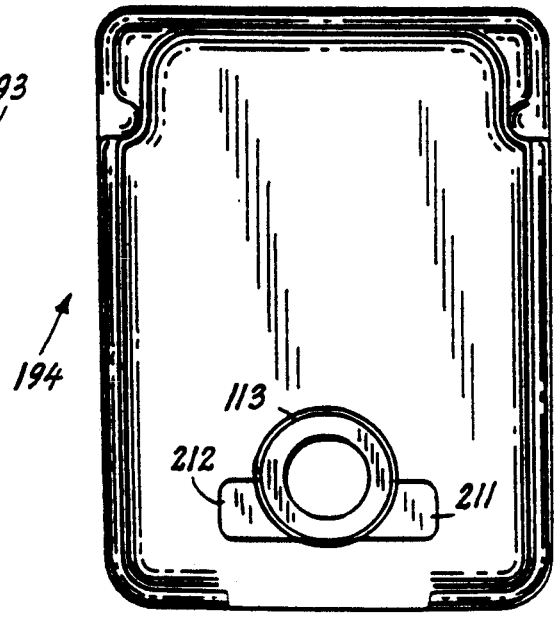
Figure 38:
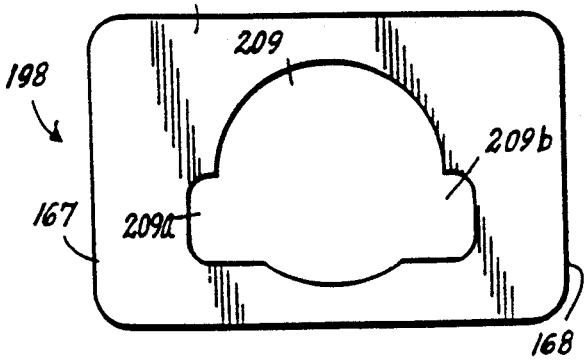

Referring to FIGS. 34 and 38, device 198 has an irregular-shaped opening 209 having two generally rectangular extension portions 209*a* and 209*b* which are the same shape as portion 201*b* (FIG. 35) and extend, respectively, toward the left side edge 167 and the right side edge 168, but forward of the center line of the plate 161. Corresponding container 194 has complementary bosses 211 and 212 on its neck portion 113 which are disposed to pass through the irregular opening 209 in the device 198.

It is seen therefore that there has been provided a liquid dispensing system in which a common dispenser 25 has permanently mounted to it a selected one of a plurality of anti-bootleg devices, overlying the actuator mechanism and upon which an associated cartridge must be mounted. The anti-bootleg device has a particularly chosen irregular-shaped opening which will preclude the use of any cartridge except a cartridge having a complementary shaped neck portion. The user of unauthorized cartridges in dispensers having the anti-bootleg device of the present invention is prevented because the anti-bootleg device precludes proper seating of the dispensing mechanism of such unauthorized cartridge on the actuator mechanism, whereby the actuator cannot operate the dispenser mechanism, thereby rendering the liquid dispenser inoperable.

We claim:

1. A liquid dispenser comprising, an unvented liquid container having only an outlet opening, a discharge assembly in liquid communication with said liquid container outlet opening, said discharge assembly including discharge means defining a discharge chamber for accommodating a charge of liquid and an inlet chamber for introducing liquid to said discharge chamber, and a check valve means in said inlet chamber for regulating the flow of liquid from said container to said discharge chamber, said check valve means including a valve member and a semipermeable filter element mounted in and substantially filling said inlet chamber between said valve member and said liquid container outlet opening, said filter element being of a material which is permeable to air for establishing an air passage to introduce air into said liquid container upon withdrawal of liquid from said container, and said filter element material being impermeable to liquid, said element having an opening therethrough defining a passageway for liquid from said container outlet opening to said valve member for introduction into said discharge chamber.

2. The liquid dispenser of claim 1, wherein an air passage connects said filter element to the outside of said liquid container.

3. The liquid dispenser of claim 1, including retaining means holding said discharge assembly in position with respect to said liquid container and providing an air passage to said filter element.

4. The liquid dispenser of claim 1, wherein said filter element is generally cylindrical in shape and has an outer diameter corresponding to the inner diameter of said container outlet opening, said opening through said filter element being located centrally thereof.

5. The liquid dispenser of claim 1, wherein said filter element is a molded porous plastic material having a pore size in the range of about 0.2 microns to about 40 microns.

6. The liquid dispenser of claim 1, wherein said filter element is a hydrophobic microporous of polypropylene.

7. The liquid dispenser of claim 1, wherein said discharge means of said discharge assembly includes an elongated flexible resilient nipple having a normal expanded condition defining said discharge chamber and having a longitudinal axis, said nipple having an inlet opening to said discharge chamber at one end thereof and being provided at the other end thereof with a normally closed discharge slit extending generally perpendicular to said axis, retaining means mounting said nipple on the container with said inlet chamber disposed in registry with the container outlet opening, said check valve means including a flat membrane extending across said nipple inlet opening and having a valve slit formed therein centrally thereof, said filter element overlying said membrane with its opening being located centrally thereof and disposed in registry with said valve slit to permit liquid to flow therethrough and to prevent said membrane from being forced into said liquid container, said retaining means retaining said nipple and said check valve and said filter element in position on said liquid container and providing an air passage from outside said liquid container to said filter element, said nipple being laterally compressible in a direction substantially perpendicular to said axis to a compressed condition, movement of said nipple to the compressed condition thereof raising the pressure in said discharge chamber for closing said check valve against said filter element and ejecting liquid from said discharge slit, movement of said nipple back to the expanded condition thereof lowering the pressure in said discharge chamber for closing said discharge slit and opening said check valve to draw a new charge of liquid into said discharge chamber, passage of air through said filter element to the interior of said container rapidly reestablishing air pressure in said liquid container permitting rapid refill and activation of said discharge means.

8. The liquid dispenser of claim 7 wherein said nipple is generally cylindrical and wherein the axial length of said discharge chamber is approximately three times its diameter.

9. A discharge assembly for a liquid dispenser including a liquid container having an outlet opening, said discharge assembly comprising an elongated flexible resilient nipple having a normal expanded condition defining a discharge chamber for accommodating a charge of liquid and having a longitudinal axis, said nipple having first and second ends with an inlet chamber at said first end thereof and being provided at said second end thereof with a normally closed discharge slit, retaining means mounting said nipple on the container with said inlet chamber disposed in registry with the container outlet opening, check valve means disposed in said inlet chamber and including a valve member and a semipermeable filter element substantially filling said inlet chamber, said filter element being of a material which is permeable to air and impermeable to liquid, said retaining means establishing an air passage through at least a portion of said filter element to the interior of said liquid container, said filter element having an opening therethrough defining a passageway for liquid from said container outlet to said valve member for introduction into said discharge chamber, said nipple being laterally compressible in a direction substantially perpendicular to said axis, movement of said nipple to the compressed condition thereof raising the pressure in said discharge chamber for closing said check valve and ejecting liquid from said discharge slit, movement of said nipple back to the expanded condition thereof lowering the pressure in said discharge chamber for closing said discharge slit and opening said check valve to draw a new charge of liquid into said discharge chamber, passage of air through said filter element rapidly reestablishing air pressure in said liquid container permitting rapid refill of said discharge chamber with liquid and rapid activation of said discharge means.

10. The discharge assembly of claim 9, wherein said valve member includes a flat membrane extending across said inlet opening and having a valve slit formed therein centrally thereof, said filter element overlying said membrane with its opening therein centrally thereof and disposed in registry with said valve slit.

11. The discharge assembly of claim 10, wherein said liquid container is threaded at the surface thereof near the outlet, said retaining means having mating threads for loose engagement with said liquid container threads and maintaining said filter element in position between said inlet opening of nipple and the outlet of said liquid container, said threads being constructed and arranged to permit the flow of air therealong.

12. The discharge assembly of claim 10 wherein said filter element is generally cylindrical in shape and engages said diaphragm over substantially its entire extent.

13. The discharge assembly of claim 12, wherein said nipple has an annular upstanding wall at said first end defining said inlet chamber and a shoulder at the base of said wall, said diaphragm having its peripheral edge supported on said shoulder and said filter element being container substantially within said inlet chamber.

14. The discharge assembly of claim 12, wherein said nipple is substantially circularly cylindrical in shape, the distal end of said nipple being generally duckbill-shaped and having sloping wall portions which converge to a thin flat rectangular tip, said discharge slit being formed in said tip.

15. The discharge assembly of claim 14 wherein the axial length of said discharge chamber is approximately three times its diameter.

16. The discharge assembly of claim 14, wherein said filter element being in liquid communication with said liquid container and with the outside of said liquid container.

* * * * *